US009199488B2

(12) United States Patent
Fujii

(10) Patent No.: US 9,199,488 B2
(45) Date of Patent: Dec. 1, 2015

(54) IMAGE FORMING APPARATUS AND IMAGE FORMATION METHOD

(71) Applicant: KYOCERA Document Solutions Inc., Osaka (JP)

(72) Inventor: Koji Fujii, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/576,116

(22) Filed: Dec. 18, 2014

(65) Prior Publication Data

US 2015/0186761 A1 Jul. 2, 2015

(30) Foreign Application Priority Data

Dec. 27, 2013 (JP) ..... 2013-271845

(51) Int. Cl.
*B41J 11/00* (2006.01)
*G03G 15/00* (2006.01)

(52) U.S. Cl.
CPC ..... *B41J 11/006* (2013.01); *B41J 11/009* (2013.01); *G03G 15/5029* (2013.01); *G03G 15/6508* (2013.01); *G03G 15/6511* (2013.01); *G03G 2215/00949* (2013.01)

(58) Field of Classification Search
CPC ..... B41J 11/006
USPC ..... 358/1.1–1.9
See application file for complete search history.

(56) References Cited

U.S. PATENT DOCUMENTS 6,559,961 B1 * 5/2003 Isernia et al. ..... 358/1.14
8,675,235 B2 * 3/2014 Yamada ..... 358/1.15
2004/0179052 A1 * 9/2004 Phillips ..... B41J 11/009 347/14
2011/0026067 A1 * 2/2011 Hamaguchi ..... B41J 11/006 358/1.14

FOREIGN PATENT DOCUMENTS

JP 2011-143590 A 7/2011

* cited by examiner

*Primary Examiner* — King Poon
*Assistant Examiner* — Ibrahim Siddo
(74) *Attorney, Agent, or Firm* — Stein IP, LLC

(57) ABSTRACT

An image forming apparatus according to the present disclosure includes a type identification value measurement portion, a determination portion and a speed adjustment portion. The type identification value measurement portion uses, when the print job is executed, a media sensor previously provided in a paper feed cassette to measure a type identification value for a sheet to be transported in the print job. The determination portion determines whether or not an incidence of paper delay corresponding to the measured type identification value for the sheet exceeds a previously set threshold value. The speed adjustment portion lowers, when as a result of the determination, the incidence of paper delay exceeds the threshold value, a transport speed of the sheet as compared with a normal transport speed to execute the print job.

3 Claims, 7 Drawing Sheets

IMAGE FORMING APPARATUS AND IMAGE FORMATION METHOD

INCORPORATION BY REFERENCE

This application is based upon and claims the benefit of priority from the corresponding Japanese Patent Application No. 2013-271845 filed on Dec. 27, 2013, the entire contents of which are incorporated herein by reference.

BACKGROUND

The present disclosure relates to an image forming apparatus and an image formation method, and more particularly relates to an image forming apparatus and an image formation method that can reduce the occurrence of discard of a toner image caused by paper delay.

Conventionally, in printing performed by a print device, a paper jam often occurs. As the cause of the paper jam, there are various causes such as an ambient temperature, humidity, the internal temperature of the print device and the type of print sheet. There are a plurality of technologies for predicting the occurrence of an abnormal state such as the paper jam described above, and in such technologies, an index value is calculated from a plurality of types of information related to the state of an image forming apparatus, and thus the occurrence of the abnormal state is predicted. Hence, since the types of information include information with no consideration given to the effect of individual variations (manufacturing variations) in the image forming apparatus, it is disadvantageously impossible to properly predict the occurrence of an abnormal state.

Hence, in order to solve such a problem, a print device is proposed that includes an acquisition portion which acquires print conditions, a print control portion which performs control for executing printing under the acquired print conditions and a storage portion which stores, based on whether or not the printing is successful, print results for each of the print conditions. The print control portion uses the print results to predict the probability of occurrence of a failure in printing under the acquired print conditions, and when it is predicted that a failure is highly likely to occur, printing is executed under similar print conditions in which a failure is unlikely to occur. Here, examples of the print conditions include temperature, humidity, an internal temperature, the type of sheet, a paper feed tray, single-sided or double-sided printing, monochrome printing/color printing, a ratio between characters and images and the amount of toner consumed. When a print failure rate corresponding to the acquired print conditions exceeds a predetermined reference value, the print control portion predicts that a failure is more likely to occur, and performs printing under other print conditions which are partially different from the above-mentioned print conditions and in which the print failure rate is less than the reference value. In this way, even when individual variations occur in the print device, by a method simpler than a conventional method, it is possible to accurately predict the occurrence of an abnormal state such as a paper jam to enhance the success rate of printing.

SUMMARY

An image forming apparatus according to an aspect of the present disclosure includes a type identification value measurement portion, a determination portion and a speed adjustment portion. The type identification value measurement portion uses, when the print job is executed, a media sensor previously provided in a paper feed cassette to measure a type identification value for a sheet to be transported in the print job. The determination portion determines whether or not an incidence of paper delay corresponding to the measured type identification value for the sheet exceeds a previously set threshold value. The speed adjustment portion lowers, when as a result of the determination, the incidence of paper delay exceeds the threshold value, a transport speed of the sheet as compared with a normal transport speed to execute the print job.

Further, another object of the present disclosure and specific advantages obtained by the present disclosure will be further clarified by the description of an embodiment to be described below.

BRIEF DESCRIPTION OF THE DRAWINGS

These and/or other aspects and advantages of the invention will become apparent and more readily appreciated from the following description of the embodiments, taken in conjunction with the accompanying drawings of which.

DETAILED DESCRIPTION

In order for the present disclosure to be understood, an embodiment of an image forming apparatus according to the present disclosure will be described below with reference to accompanying drawings. The following embodiment is an example obtained by embodying the present disclosure, and is not intended to limit the technical scope of the present disclosure. The letter S of the alphabet provided in front of a number in the flow chart means a step.

<Image Forming Apparatus>

Figure 1:
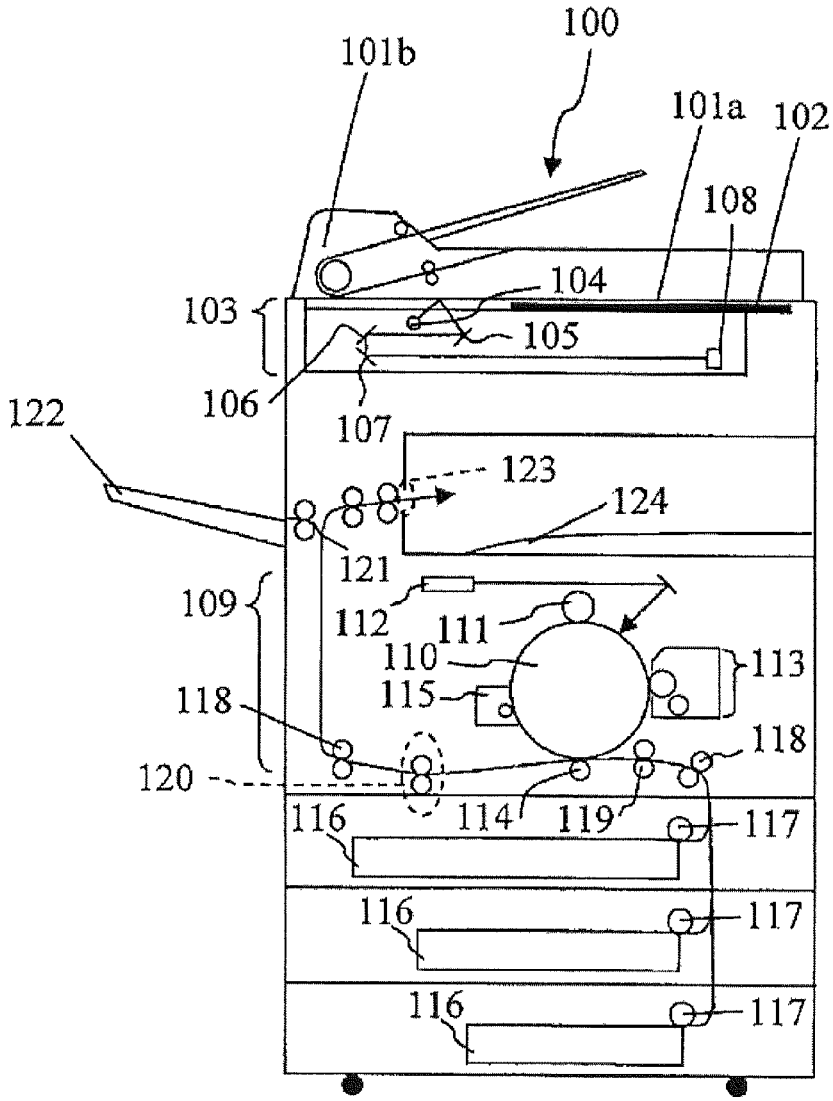
FIG. 1 A conceptual diagram showing the overall configuration of the interior of a multifunction peripheral according to an embodiment of the present disclosure.

The image forming apparatus according to the embodiment of the present disclosure is, for example, an image forming apparatus, and this image forming apparatus will be described below. FIG. 1 is a schematic diagram of the image forming apparatus according to the embodiment of the present disclosure. Detailed description of portions that are not directly related to the present disclosure will be omitted.

The image forming apparatus of the present disclosure applies to, for example, a printer or a single scanner or a multifunction peripheral including a printer, a copier, a scanner and a facsimile, and functions as an image forming apparatus that includes a copying function, a scanner function, a facsimile function and a printer function.

An operation of a multifunction peripheral 100 (MFP: multifunction peripheral) when for example, a copying function is utilized will be briefly described below.

When a user utilizes the multifunction peripheral 100, an original document is first placed on an original document stage 101*a* or a placement stage 101*b* of an automatic original document paper feed portion provided on the upper surface of a housing portion. Then, the user uses an operation portion 102 (operation panel) provided in the vicinity of the original document stage 101*a*, and thereby inputs setting conditions on image formation through an operation screen of the operation portion 102. Then, when the user presses down a start key provided in the operation portion 102, the multifunction peripheral 100 starts the image formation (print processing).

Then, in an image reading portion 103, light applied from a light source 104 is reflected off the original document placed on the original document stage 101*a*. The reflected light is guided by mirrors 105, 106 and 107 to an image sensing element 108. The guided light is subjected to photoelectric conversion by the image sensing element 108 to produce image data corresponding to the original document.

A portion that forms a toner image based on the image data is an image formation portion 109. In the image formation portion 109, a photosensitive drum 110 is provided. The photosensitive drum 110 is rotated at a constant speed in a predetermined direction. Around the photosensitive drum 110, sequentially from the upstream side in the rotation direction, a charging unit 111, an exposure unit 112, a development unit 113, a transfer unit 114, a cleaning unit 115 and the like are arranged.

The charging unit 111 uniformly charges the surface of the photosensitive drum 110. The exposure unit 112 applies laser light to the charged surface of the photosensitive drum 110 based on the image data, and thereby forms an electrostatic latent image. The development unit 113 adheres toner to the formed electrostatic latent image, and thereby forms the toner image. The formed toner image is transferred by the transfer unit 114 to a recording medium (for example, a sheet). The cleaning unit 115 removes the extra toner left on the surface of the photosensitive drum 110. A series of processes described above are performed by the rotation of the photosensitive drum 110.

The sheet is transported from a plurality of paper feed cassettes 116 provided in the multifunction peripheral 100. When the sheet is transported, the sheet is drawn by a pickup roller 117 from any one of the paper feed cassettes 116 to a transport path. A different type of sheet is stored in each of the paper feed cassettes 116, and the sheet is fed based on setting conditions on the image formation.

The sheet drawn to the transport path is fed by a transport roller 118 and a registration roller 119 between the photosensitive drum 110 and the transfer unit 114. Then, the toner image is transferred by the transfer unit 114 to the sheet, and the sheet is transported to a fixing device 120.

When the sheet to which the toner image has been transferred is passed between a heating roller and a pressure roller provided in the fixing device 120, heat and pressure are applied to the toner image, and a visible image is fixed to the sheet. The amount of heat of the heating roller is optimally set according to the type of paper, and thus the fixing is appropriately performed. The visible image is fixed to the sheet, the image formation is completed and the sheet is guided by the transport roller 118 to a path switching portion 121.

In the path switching portion 121, for example, according to a switching instruction provided by the multifunction peripheral 100, the sheet is guided to an ejection tray 122 provided on the side surface of the housing portion or is guided through a paper ejection port 123 to a body inside tray 124 provided within the body of the housing portion. The sheet is stacked on the ejection tray 122 or the body inside tray 124 and is stored therein. The multifunction peripheral 100 provides the user with the copying function by the procedure described above.

Figure 2:
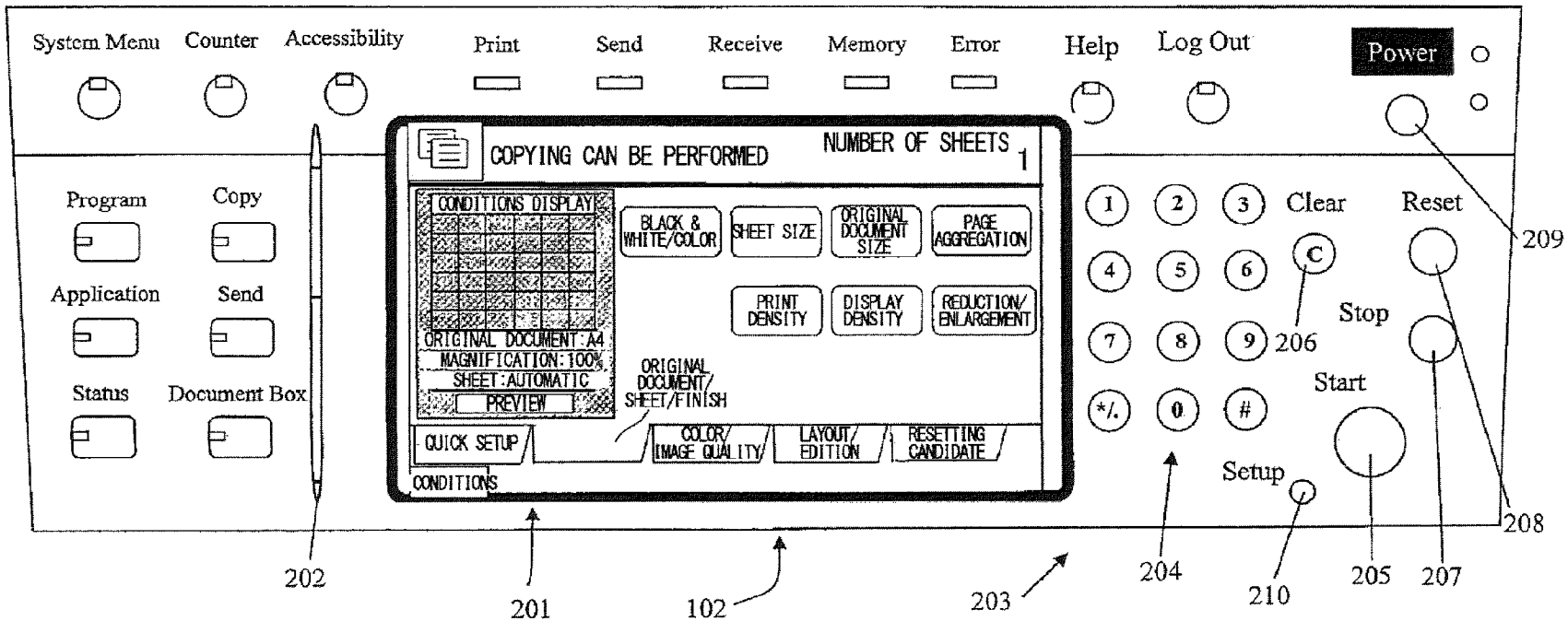
FIG. 2 A conceptual diagram showing the overall configuration of an operation portion of the multifunction peripheral according to the embodiment of the present disclosure.

FIG. 2 is a conceptual diagram showing the overall configuration of the operation portion of the multifunction peripheral 100 according to the embodiment of the present disclosure. The user uses the operation portion 102 to input the setting conditions on the image formation described above or to confirm setting conditions which are input. When the setting conditions are input, a touch panel 201 (the operation panel) provided on the operation portion 102, a touch pen 202 or operation keys 203 are used.

In the touch panel 201, both a function of inputting setting conditions and a function of displaying the setting conditions are provided. In other words, a key within a screen displayed on the touch panel 201 is pressed down, and thus the setting conditions corresponding to the pressed key are input.

On the back surface of the touch panel 201, a display portion (not shown) such as a LCD (liquid crystal display) is provided, and the display portion displays, for example, an operation screen such as an initial screen. In the vicinity of the touch panel 201, the touch pen 202 is provided, and when the user brings the tip of the touch pen 202 into contact with the touch panel 201, a sensor provided under the touch panel 201 detects a touched area.

Furthermore, in the vicinity of the touch panel 201, a predetermined number of operation keys 203 are provided, and for example, a numeric keypad 204, a start key 205, a clear key 206, a stop key 207, a reset key 208 and a power supply key 209 are provided.

Figure 3:
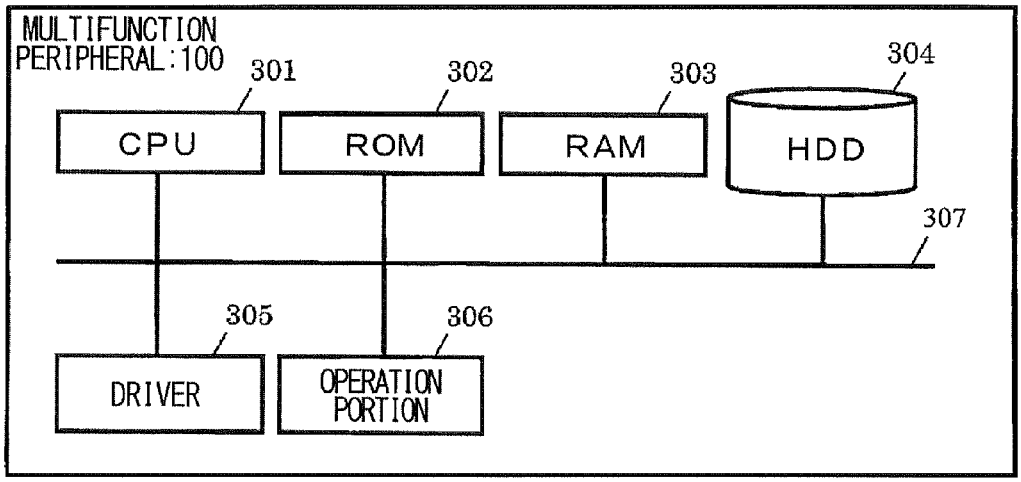
FIG. 3 A diagram showing the configuration of control system hardware in the multifunction peripheral according to the embodiment of the present disclosure.

The configuration of control system hardware in the multifunction peripheral 100 will then be described with reference to FIG. 3. FIG. 3 is a diagram showing the configuration of the control system hardware in the multifunction peripheral 100 according to the present disclosure. However, detailed description of portions that are not directly related to the present disclosure will be omitted.

In the control circuit of the multifunction peripheral 100, a CPU (central processing unit) 301, a ROM (read only memory) 302, a RAM (random access memory) 303, a HDD (hard disk drive) 304, a driver 305 corresponding to individual drive portions and an operation portion 306 (102) are connected by an internal bus 307.

The CPU 301 utilizes, for example, the RAM 303 as an operation region, executes programs stored in the ROM 302, the HDD 304 and the like, receives, based on the results of the execution, data and instructions from the driver 305 and the operation portion 306 and signals, commands and the like corresponding to the keys and thereby controls the operations of the individual drive portions shown in FIG. 1.

Figure 4:
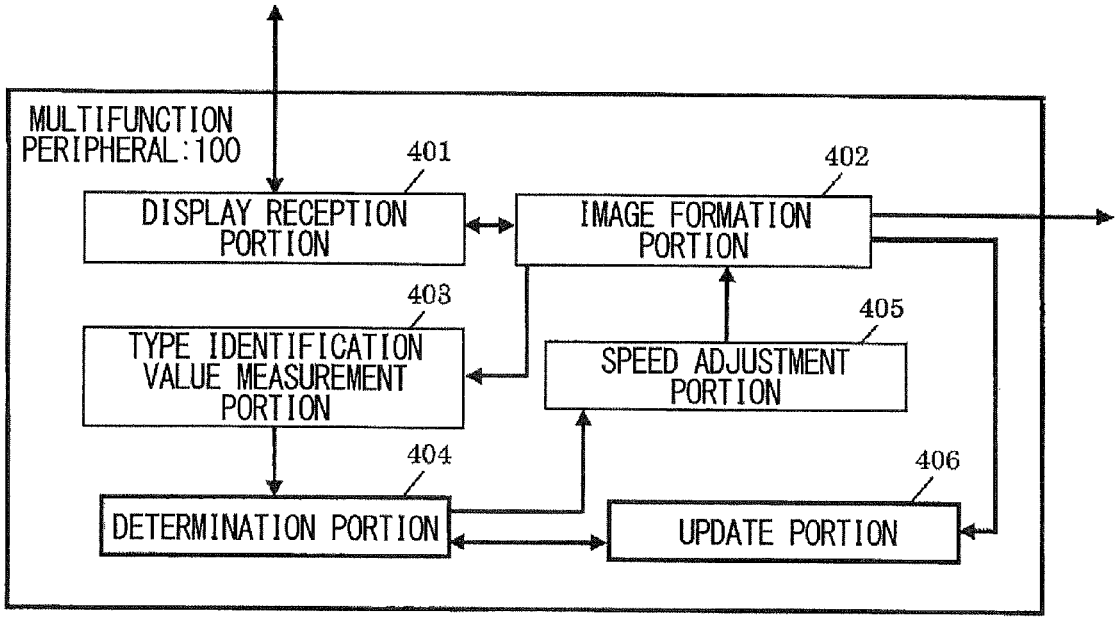
FIG. 4 A function block diagram of the multifunction peripheral according to the embodiment of the present disclosure.

For a display reception portion 401, an image formation portion 402, a type identification value measurement portion 403, a determination portion 404, a speed adjustment portion 405 and an update portion 406 (each of which is shown in FIG. 4) other than the drive portions and described later, the CPU 301 executes programs to realize the individual portions. In the ROM 302, the HDD 304 and the like, programs and data that realize the individual portions described later are stored.

<Embodiment of the Present Disclosure>

Figure 5:
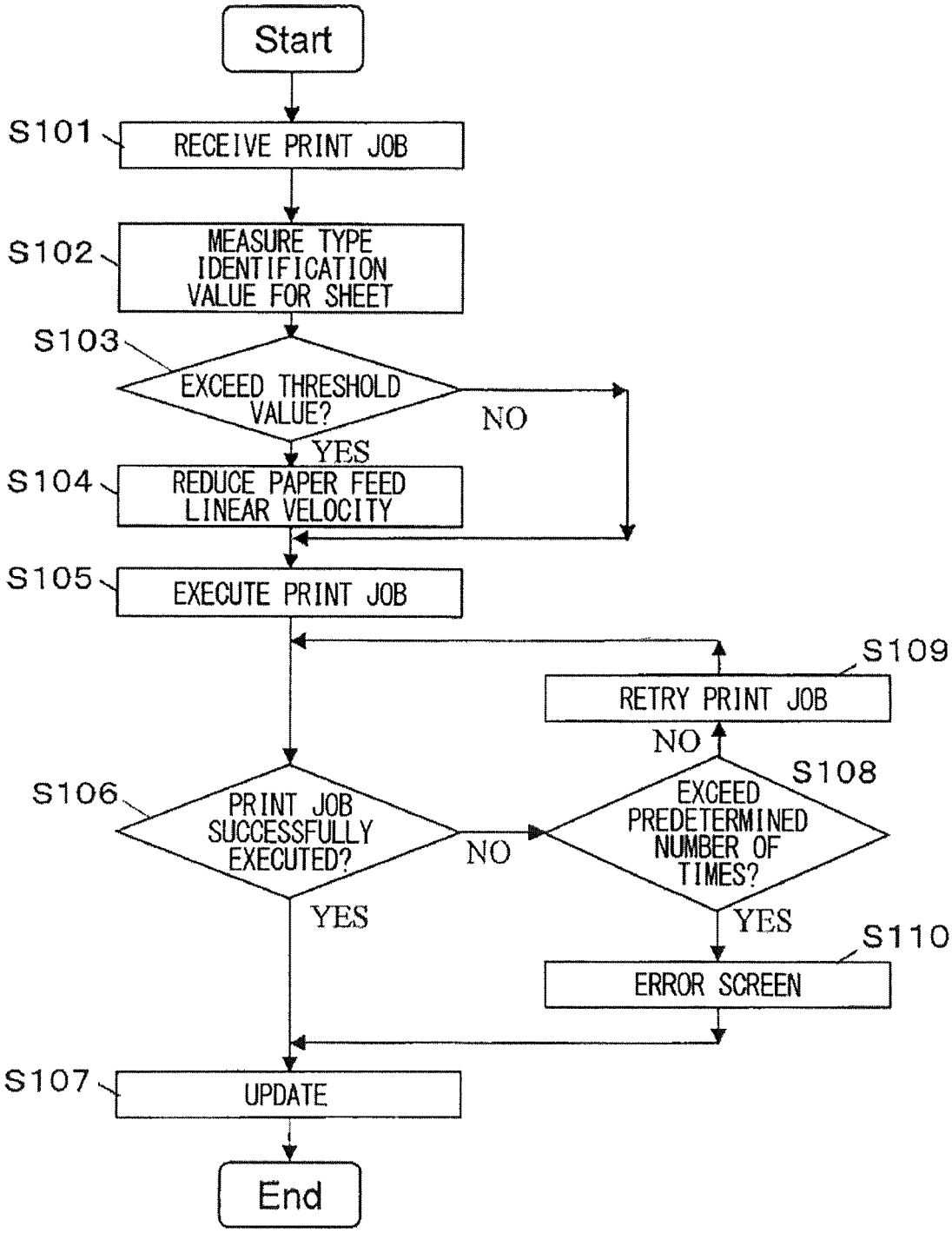
FIG. 5 A flowchart showing the execution procedure of the multifunction peripheral according to the embodiment of the present disclosure.

The configuration and the execution procedure of the multifunction peripheral 100 according to the embodiment of the present disclosure will then be described with reference to FIGS. 4 and 5. FIG. 4 is a function block diagram showing the multifunction peripheral 100 according to the embodiment of the present disclosure. FIG. 5 is a flowchart showing the execution procedure of the multifunction peripheral 100 according to the embodiment of the present disclosure.

When the user first turns on the power supply of the multifunction peripheral 100, the multifunction peripheral 100 is started up, and the display reception portion 401 displays the initial screen (operation screen) on the touch panel 201.

When while seeing the initial screen, the user places the original document on the original document stage 101*a*, inputs desired setting conditions (for example, the sheet size is A4 size) and presses down the start key 205, the display reception portion 401 receives the setting conditions and the pressing down of the start key 205, and notifies the information thereof to the image formation portion 402. The image formation portion 402 receiving the notification receives a print job corresponding to the setting conditions (FIG. 5: S101).

As the method in which the image formation portion 402 receives the print job, in addition to the method described above, a method of receiving the print job from a terminal device which is connected to the multifunction peripheral 100 such that they can communicate with each other may be adopted.

When the image formation portion 402 receives the print job, the image formation portion 402 starts the execution of the print job, for example, reads the image data of the original document on the original document stage 101*a* according to the setting conditions and starts to transport the sheet from the paper feed cassette 116 where a predetermined sheet is stored.

Here, when the image formation portion 402 starts the print job, the image formation portion 402 notifies the information thereof to the type identification value measurement portion 403. The type identification value measurement portion 403 receiving the notification uses a media sensor 600 (see FIG. 6A) previously provided in the paper feed cassette 116, and thereby measures the type identification value for the sheet to be transported by the print job (FIG. 5: S102).

Figure 6A:
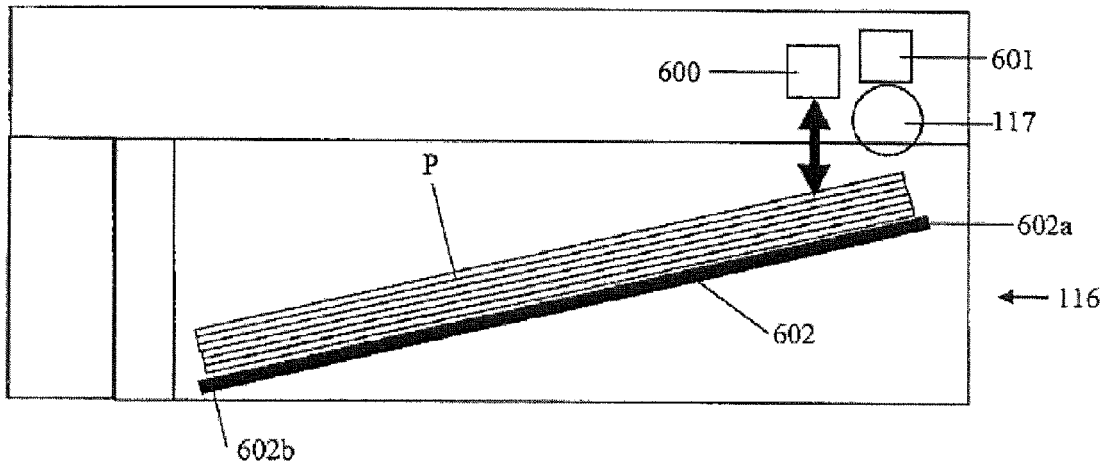
FIG. 6A A diagram showing an example of the configuration of a paper feed cassette of the multifunction peripheral according to the embodiment of the present disclosure.

Here, although as the method in which the type identification value measurement portion 403 measures the type identification value for the sheet, any method may be adopted, for example, the following method may be performed. Specifically, the type identification value measurement portion 403 first starts up the media sensor 600 in the paper feed cassette 116 (for example, one paper feed cassette 116 corresponding to A4 of the sheet size) selected under the setting conditions described previously. Here, the media sensor 600 is previously provided for each of the paper feed cassettes 116 in a predetermined position of the paper feed cassette 116 where the type identification value for the sheet can be measured; for example, as shown in FIG. 6A, the media sensor 600 is provided in the vicinity of a lift plate upper limit detection sensor 601 on the upstream side. Immediately below the lift plate upper limit detection sensor 601, the pickup roller 117 of the paper feed cassette 116 is arranged, and immediately below the pickup roller 117, the free end 602*a* of a lift plate 602 in the paper feed cassette 116 is arranged. The fixed end 602*b* of the lift plate 602 is provided such that it can be turned, and the free end 602*a* of the lift plate 602 is raised by an unillustrated lift raising portion, and thus a sheet pile P placed on the free end 602*a* of the lift plate 602 is brought into contact with the pickup roller 117 and the pickup roller 117 is pushed upward. The pushing up of the pickup roller 117 described above is detected by the lift plate upper limit detection sensor 601, and the raising of the lift raising portion is stopped.

Here, the media sensor 600 is provided in the vicinity of the lift plate upper limit detection sensor 601, and thus it is possible to detect the surface of the sheet pile P and thereby measure the type identification value for the sheet.

The type identification value for the sheet may be any measurement value, and examples thereof include a reflectance, a wavelength, transparency and the like on the surface of the sheet; in the embodiment of the present disclosure, a description will be given using a reflectance as the type identification value for the sheet. When the type identification value for the sheet is a reflectance, the media sensor 600 include, for example, a light source LED for the application of light, a first image formation lens for image formation on the light of the light source LED, a second image formation lens for image formation on the reflected light obtained by the reflection of the light, from the sheet P, of the image formation by the first image formation lens and a CMOS sensor for shooting the reflected light of the image formation. Then, the light from the light source LED is applied through the first image formation lens to the surface of the sheet P, the reflected light from the sheet P is collected through the second image formation lens and the image is formed on the CMOS sensor. In this way, the image on the surface of the sheet P is sensed and is converted into a value (analog conversion), and its value is measured as the reflectance (the type identification value).

When the type identification value measurement portion 403 measures the type identification value for the sheet, the information thereof is notified to the determination portion 404, and the determination portion 404 receiving the notification determines whether or not an incidence of paper delay corresponding to the measured type identification value for the sheet exceeds a previously set threshold value (FIG. 5: S103). The incidence of paper delay means a ratio (%) obtained by dividing, when the multifunction peripheral 100 executes a print job to transport a sheet, the number of times the transport of the sheet is delayed (the number of times a paper delay occurs) by the number of times the sheet is transported in the execution of the print job. When this paper delay does not occur, the execution of the print job is successfully performed (completed) by performing the transport of the sheet and the image formation of the toner image at the same speed. Hence, the incidence of paper delay corresponds to a print failure rate that indicates a failure in the execution of the print job. When this paper delay occurs, the toner image formed according to the sheet is discarded and is useless.

Although here, as the method of determining, by the determination portion 404, whether or not the incidence of paper delay exceeds the threshold value, any method may be adopted, for example, the following method is performed. Specifically, the determination portion 404 first references a graph 603 previously stored in a predetermined memory.

Figure 6B:
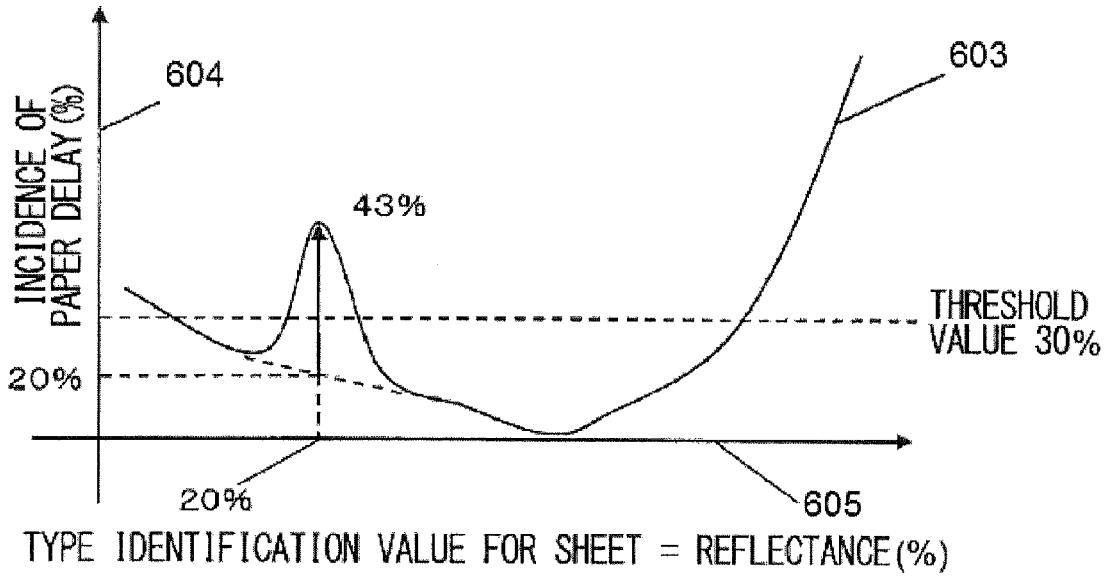
FIG. 6B A diagram showing an example of the relationship between a type identification value for a sheet and an incidence of paper delay in the multifunction peripheral according to the embodiment of the present disclosure.

In the graph 603, as shown in FIG. 6B, the vertical axis represents an incidence of paper delay 604 (%), the horizontal axis represents a type identification value 605 (reflectance (%)) for the sheet, a curve that reflects the past record of the multifunction peripheral 100 is formed. In the graph 603, a large number of types of curves are drawn according to the configuration and the type of the multifunction peripheral 100, the state of wear of a pickup roller 117, the compatibility between the pickup roller 117 and the surface (reflecting the type identification value) of the sheet and the like. The graph 603 is referenced, and thus it is possible to acquire the incidence of paper delay 604 in the multifunction peripheral 100 corresponding to the type identification value 605 for a predetermined sheet.

Here, the determination portion 404 references the graph 603, acquires the incidence of paper delay 604 (for example, 20%) corresponding to the measured type identification value 605 of the sheet (for example, a reflectance of 20%), compares the acquired incidence of paper delay 604 with the threshold value (30%) and determines whether or not the incidence of paper delay exceeds the threshold value.

As the result of the determination, when the incidence of paper delay exceeds the threshold value (FIG. 5: yes in S103), the determination portion 404 determines that the sheet to be transported from now is highly likely to undergo a paper delay, and notifies the information thereof to the speed adjustment portion 405. The speed adjustment portion 405 receiving the notification reduces the transport speed (paper feed linear velocity, image formation speed) of the sheet to the normal transport speed, and executes the print job (FIG. 5: S104). The transport speed of the sheet corresponds to the image formation speed without being processed.

Although as the method of reducing, by the speed adjustment portion 405, the transport speed of the sheet to execute the print job, any method may be adopted, for example, the following method is performed. Specifically, the speed adjustment portion 405 changes the transport speed (the image formation speed) of the sheet set by the image formation portion 402 in the execution of the print job to a reduction speed obtained by performing the reduction at a predetermined ratio. As long as the transport speed is lowered as compared with the normal speed, the ratio may be any value. For example, one half, two thirds, one third, three fourths, one fourth or the like can be adopted as the ratio.

When the speed adjustment portion 405 reduces the transport speed of the sheet, the information thereof is notified to the image formation portion 402, and the image formation portion 402 receiving the notification transports the sheet based on the reduced transport speed of the sheet, and executes the print job (FIG. 5: S105).

In the conventional technology described above, when the sheet inserted in the cassette is poor in quality, even if the print conditions are changed, a paper delay (the delay of the sheet) occurs due to slip at the time of paper feed, with the result that the printing may be unsuccessfully performed. In the conventional technology described above, although the print failure rate is held for each of the print conditions, since various types of sheets are inserted into the cassette, the correlation between the print conditions and the print failure rate is not accurately achieved, with the result that the printing may be unsuccessfully performed.

Here, when a paper delay occurs, all toner images formed with the assumption that the paper is properly transported are discarded. In other words, when a paper delay occurs, and the printing is unsuccessfully performed, the toner image is uselessly and disadvantageously discarded.

In the present embodiment, since the transport speed of the sheet is reduced, and thus it is possible to reduce the probability that the printing is unsuccessfully performed by paper delay, it is possible to reliably reduce the unsuccessful execution of a print job, for example, the discard of a toner image which is problematic in the conventional technology and which is caused by paper delay.

In other words, in the present disclosure, from the step preceding the execution of the print job (the step preceding the transport of the sheet), based on the type identification value for the sheet, the transport speed of the sheet is lowered. Hence, in the step preceding the formation of the toner image, it is possible to adjust the transport speed of the sheet, that is, the productivity of the entire multifunction peripheral 100. Thus, it is possible to reliably prevent the discard of the toner image in the conventional technology.

On the other hand, as the result of the determination, when the incidence of paper delay does not exceed the threshold value (FIG. 5: no in S103), the determination portion 404 determines that the sheet to be transported from now is unlikely to undergo a paper delay, and notifies the information thereof to the speed adjustment portion 405. The speed adjustment portion 405 receiving the notification changes the transport speed of the sheet to the normal transport speed, and executes the print job. In other words, the speed adjustment portion 405 does not perform anything in particular, and notifies the information thereof to the image formation portion 402. The image formation portion 402 receiving the notification executes the print job based on the normal transport speed of the sheet (FIG. 5: S105).

In this way, when the incidence of paper delay is low, the print job is executed at the normal transport speed of the sheet, and thus it is possible to maintain the productivity of the multifunction peripheral 100.

In general, when a predetermined sheet is transported at a constant normal transport speed, depending on the type of sheet, the sheet may slip a large number of times to cause paper delays frequently or the sheet may hardly slip. Hence, in the present disclosure, with consideration given to the incidence of paper delay corresponding to the type of sheet, the transport speed of the sheet is lowered or maintained. In this way, for any print job, it is possible to lower the incidence of paper delay as much as possible and execute the print job.

Here, when as the result of the execution of the print job by the image formation portion 402, the print job is successfully executed, that is, when the sheet is successfully transported (FIG. 5: yes in S106), the image formation portion 402 notifies the information thereof to the update portion 406. The update portion 406 receiving the notification updates, based on the transport of the sheet in the print job, the incidence of paper delay corresponding to the measured type identification value for the sheet (FIG. 5: S107).

Although, as the method of updating, by the update portion 406, the incidence of paper delay, any method may be adopted, for example, the following method is performed. Specifically, the update portion 406 recalculates the incidence of paper delay corresponding to the measured type identification value for the sheet with consideration given to the number of times the sheet is transported in the completed print jobs, and restores it in the graph 603. More specifically, when the incidence of paper delay corresponding to the measured type identification value for the sheet is set at 20% with the assumption that the number of times the transport of the sheet is delayed is 2, and that the number of times the sheet is transported in the execution of the previous print jobs is 10, and in the preceding print job, it is assumed that the number of times the transport of the sheet is delayed is 0, and that the number of times the sheet is transported is 6, the recalculated incidence of paper delay is $(2/16)\times100$=about 13%. In this way, since the sheet is successfully transported, and the print job is successfully executed, and thus the incidence of paper delay is lowered, with consideration given to the successful execution of the print job, it is possible to maintain the transport speed of the sheet as much as possible and to prevent the productivity of the multifunction peripheral 100 from being lowered.

On the other hand, in S106, when as the result of the execution of the print job by the image formation portion 402, the print job is unsuccessfully executed, that is, when the sheet is unsuccessfully transported (FIG. 5: no in S106), the image formation portion 402 determines whether or not the number of times the print job is retried exceeds a predetermined number of times (for example, twice) (FIG. 5: S108). At the present time, the number of times the print job is retried is 0.

As a result of the determination, when the number of times the print job is retried does not exceed the predetermined number of times (FIG. 5: no in S108), for example, the image formation portion 402 discards the toner image formed for the sheet, transports a new sheet again and retries the print job (FIG. 5: S109). Here, the image formation portion 402 adds one to the number of times the print job is retired.

As a result of the retrying of the print job, when the process returns to S106, the print job is successfully executed and the sheet is successfully transported (FIG. 5; yes in S106), as in the case described above, with consideration given to the number of times the print job is retired, the update portion 406 updates the incidence of paper delay corresponding to the measured type identification value for the sheet (FIG. 5: S107).

On the other hand, when the type of sheet is poor, the sheet is hardly transported, for example, the retrying of the print job is repeated a plurality of times and the number of times the print job is retired exceeds the predetermined number of times (FIG. 5: yes in S108), the image formation portion 402 gives up the successful transport of the sheet, stops the print job and displays, on the display reception portion 401, an error screen displaying the information thereof (FIG. 5: S110). In this way, the user can find that it is impossible to successfully execute the print job with this sheet.

The image formation portion 402 notifies the information thereof to the update portion 406, and the update portion 406 receiving the notification updates, with consideration given to the number of times the print job is retried, the incidence of paper delay corresponding to the measured type identification value for the sheet (FIG. 5: S107).

Here, with respect to the updating of the incidence of paper delay, for example, when the incidence of paper delay is set at 20% with the assumption that before the stop of the print job, the number of times the transport of the sheet is delayed is 2, and that the number of times the sheet is transported in the execution of the previous print jobs is 10, and in the stopped print job, it is assumed that the number of times the transport of the sheet is delayed is 4 (the number of time the first sheet is transported=1+the number of times the print job is retried=3), and that the number of times the sheet is transported is 4, the recalculated incidence of paper delay is (6/14)×100=about 43%. Then, for example, as shown in FIG. 6B, the incidence of paper delay where the measured type identification value is 20% is increased from 20% to 43%, and exceeds the threshold value of 30%. Thus, when the paper delay occurs a large number of times, based on the history thereof, the incidence of paper delay in the type identification value for the sheet is increased. Hence, when on a sheet having a type identification value equivalent to the type identification value for the sheet, the print job is executed, it is possible to lower the transport speed of the sheet from the beginning, with the result that it is possible to reduce the incidence of paper delay.

Figure 7:
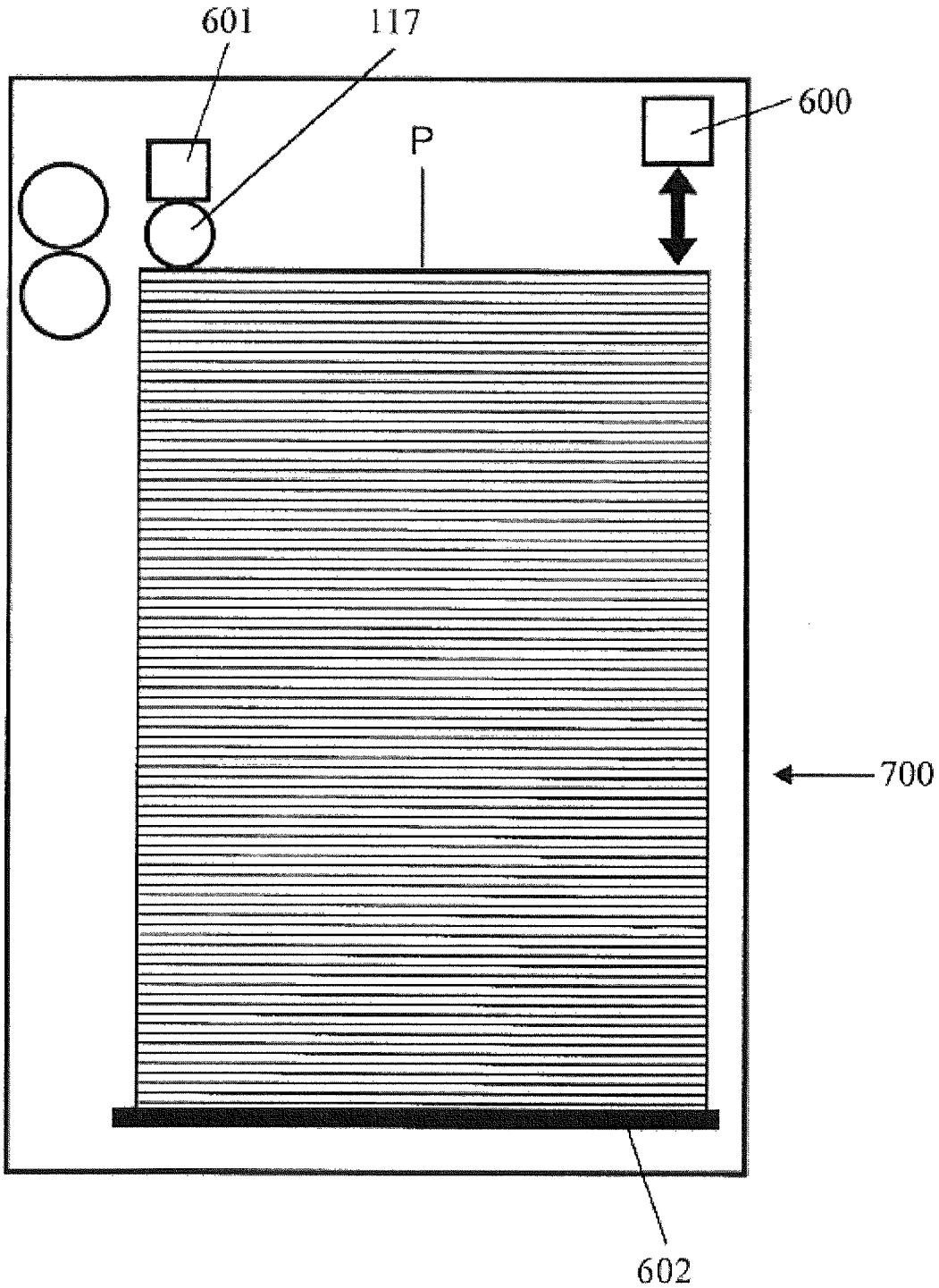
FIG. 7 A diagram showing an example of the configuration of a large-capacity paper feed device in the multifunction peripheral according to the embodiment of the present disclosure.

A paper feed device whose configuration is different from that of the paper feed cassette 116 will then be described. FIG. 7 is a diagram showing an example of the configuration of a large-capacity paper feed device 700 in the multifunction peripheral according to the embodiment of the present disclosure. The same elements as in the paper feed cassette 116 are identified with the same numbers, and their detailed description will be omitted. The lift plate 602 of the large-capacity paper feed device 700 is moved upward by an unillustrated drive unit with the horizontal position maintained. Then, the lift plate 602 brings the sheet pile P stored on the lift plate 602 into contact with the pickup roller 117 arranged directly below the lift plate upper limit detection sensor 601, and pushes the sheet pile P upward. The pickup roller 117 is driven to rotate, and thereby transports the sheet in the uppermost surface of the sheet pile P leftward in FIG. 7. In the large-capacity paper feed device 700, unlike the paper feed cassette 116, the media sensor 600 is arranged in the vicinity of an end portion on the upstream side in the transport direction of the sheet above the sheet pile P. In the multifunction peripheral 100 according to the embodiment of the present disclosure, the execution procedure for forming an image on the sheet stored in the large-capacity paper feed device 700 is the same as that shown in the flowchart of FIG. 5.

The delay of the transport of the sheet is related to a friction force between the sheet and the pickup roller 117 and a friction force between the transported sheet and the sheet thereunder. Since the large-capacity paper feed device 700 can store a large number of sheets as compared with the paper feed cassette 116, a sheet which has the same sheet size but whose type of paper is different may be stored. Hence, the type of sheet transported previously may be different form the type of sheet transported subsequently. In this case, even when in the previously transported sheet, the incidence of paper delay is lower than a previously set threshold value, the incidence of paper delay is likely to be increased due to the effect of the frictional force between the previously transported sheet and the subsequent sheet. However, since in the large-capacity paper feed device 700, the media sensor 600 is arranged in the vicinity of the end portion on the upstream side in the transport direction of the sheet, the type of subsequent sheet can be checked immediately after the transport of the uppermost sheet is started. When the type of subsequent sheet is different from the type of previously transported sheet, it is also possible to control the transport speed by predicting again the incidence of paper delay in the previous sheet before the start of the processing by the image formation portion 402.

As described above, in the present disclosure, the followings are included: the type identification value measurement portion 403 that uses, when the print job is executed, the media sensor 600 previously provided in the paper feed cassette and that thereby measures the type identification value for the sheet to be transported in the print job; the determination portion 404 that determines whether or not the incidence of paper delay corresponding to the measured type identification value for the sheet exceeds the previously set threshold value; and the speed adjustment portion 405 that reduces, when as a result of the determination, the incidence of paper delay exceeds the threshold value, the transport speed of the sheet to the normal transport speed to execute the print job.

In this way, it is possible to reduce the occurrence of the discard of the toner image caused by paper delay.

Although in the embodiment of the present disclosure, based on the number of times the paper delay occurs, the incidence of paper delay is calculated, the number of times the transport of the sheet is delayed in all the print jobs executed may be calculated.

Although in the embodiment of the present disclosure, the configuration is adopted in which the image formation portion 402 retries the print job under a condition where the print job is unsuccessfully executed, in particular, in which the print job is retried while the transport speed of the sheet is maintained, another configuration may be adopted. For example, a configuration may be adopted in which when the image formation portion 402 retries the print job, the speed adjustment portion 405 reduces the transport speed of the sheet in the retried print job to the transport speed of the sheet in the unsuccessfully executed print job, and the print job is retried. In this way, it is possible to perform the print job as successfully as possible at the time of the retrying.

Although in the embodiment of the present disclosure, the multifunction peripheral 100 includes the display reception portion 401, the image formation portion 402, the type identification value measurement portion 403, the determination portion 404, the speed adjustment portion 405 and the update portion 406, programs for realizing the individual portions may be stored in a storage medium, and the storage medium may be provided. In this case, the programs are read by the multifunction peripheral 100, and thus the multifunction peripheral 100 realizes the individual portions. In this case, the programs themselves read from the recording medium provide the action effects of the present disclosure. Furthermore, it is possible to provide a method of storing, in a hard disk, steps performed by the individual portions.

In other words, the display reception portion 401, the image formation portion 402, the type identification value measurement portion 403, the determination portion 404, the speed adjustment portion 405 and the update portion 406 may be provided as programs that are passed individually through an electrical communication line or the like and that are executed by a computer. In this case, a central processing unit (CPU) woks with individual circuits other than the CPU according to the programs to realize a control operation. The individual portions realized with the programs and the CPU may be configured with dedicated hardware. The programs can also be passed in a state where they are recorded in a computer-readable recording medium such as a CD-ROM.

As described above, the image forming apparatus and the sheet type detection method according to the present disclosure are useful for not only a multifunction peripheral but also a scanner, a copier, a printer and the like, and are effective as an image forming apparatus and a sheet type detection method that can reduce the occurrence of the discard of a toner image caused by paper delay.

What is claimed is:

1. An image forming apparatus that transports, when receiving a print job, a sheet and that performs image formation, the image forming apparatus comprising:

a type identification value measurement portion that uses, when the print job is executed, a media sensor previously provided in a paper feed cassette to measure a type identification value for the sheet to be transported in the print job;

a determination portion that determines whether or not an incidence of paper delay corresponding to the measured type identification value for the sheet exceeds a previously set threshold value; and a speed adjustment portion that lowers, when as a result of the determination, the incidence of paper delay exceeds the threshold value, a transport speed of the sheet as compared with a normal transport speed to execute the print job and that changes, when as a result of the determination, the incidence of paper delay does not exceed the threshold value, the transport speed of the sheet to the normal transport speed to execute the print job, wherein the incidence of paper delay is calculated by dividing, when the print job is executed to transport the sheet, a number of times transport of the sheet is delayed by the number of times the sheet is transported in execution of the print job, and the threshold value is set at 30% or more.

2. The image forming apparatus according to claim 1, further comprising:

an update portion that updates, when the print job is successfully executed or the print job is stopped, based on the transport of the sheet in the print job, the incidence of paper delay corresponding to the measured type identification value for the sheet.

3. An image formation method in an image forming apparatus that transports, when receiving a print job, a sheet and that performs image formation, the image formation method comprising:

a step of using, when the print job is executed, a media sensor previously provided in a paper feed cassette to measure a type identification value for the sheet to be transported in the print job;

a step of determining whether or not an incidence of paper delay corresponding to the measured type identification value for the sheet exceeds a previously set threshold value; and a step of lowering, when as a result of the determination, the incidence of paper delay exceeds the threshold value, a transport speed of the sheet as compared with a normal transport speed to execute the print job and changing, when as a result of the determination, the incidence of paper delay does not exceed the threshold value, the transport speed of the sheet to the normal transport speed to execute the print job, wherein the incidence of paper delay is calculated by dividing, when the print job is executed to transport the sheet, a number of times transport of the sheet is delayed by the number of times the sheet is transported in execution of the print job, and the threshold value is set at 30% or more.

* * * * *